United States Patent [19]

Cary

[11] 4,403,903

[45] Sep. 13, 1983

[54] EXTENSION MEMBER FOR SURROGATE FORKS FOR A FORK LIFT TRUCK

[76] Inventor: Arthur P. Cary, P.O. Drawer AC, Hutchins, Tex. 75141

[21] Appl. No.: 303,727

[22] Filed: Sep. 21, 1981

Related U.S. Application Data

[63] Continuation-in-part of Ser. No. 962,552, Nov. 20, 1978, Pat. No. 4,290,729.

[51] Int. Cl.[3] ..... B66F 9/12

[52] U.S. Cl. ..... 414/607; 403/109; 414/608

[58] Field of Search ..... 414/607, 608, 446, 912; 403/305, 109, 110, 361, 263

[56] References Cited

U.S. PATENT DOCUMENTS

| | | | |
|---|---|---|---|
| 3,383,694 | 5/1968 | Strohmeyer, Jr. | 403/109 |
| 3,489,305 | 1/1970 | Palmateer | 414/607 |
| 3,583,061 | 6/1971 | Adams | 414/607 X |
| 3,587,893 | 6/1971 | Laken | 414/607 |
| 3,791,544 | 2/1974 | Moses | 414/607 |
| 3,850,322 | 11/1974 | Miles et al. | 414/607 |

*Primary Examiner*—Robert J. Spar
*Assistant Examiner*—Terrance L. Siemens

[57] ABSTRACT

This invention relates to an extension for fork lift trucks that provides an attachment for increasing the depth to which forks may descend and operate, and the improvement thereto of a simple, economical, and effective joining member in the form of a channel, which replaces the former tubular joining member, and which has certain operational advantages thereover.

7 Claims, 4 Drawing Figures

EXTENSION MEMBER FOR SURROGATE FORKS FOR A FORK LIFT TRUCK

This application is a continuation-in-part of my copending application, Ser. No. 962,552, filed Nov. 20, 1978, entitled Angular Detachable Extension to the Fork of Fork Lift Trucks, now U.S. Pat. No. 4,290,729. Said patent application is incorporated in this application by reference.

BACKGROUND OF THE INVENTION

1. Field

The present invention relates to industrial vehicles and more particularly to extensions for the forks of fork lift trucks of the type shown in the parent application.

2. Description of the Prior Art

The known prior art is cited in the parent application, and is as follows:

McCracken U.S. Pat. No. 3,050,206, for Load Handling Systems, shows an I beam for extending a load engaging member thru a swivel joint.

Costello U.S. Pat. No. 3,258,145, for Stepped Pallet Forks, discloses a horizontal extension member which is bolted to the forks and fits over the forks to impart steps thereto.

Stevenson U.S. Pat. No. 2,068,825, for Industrial Truck, shows a C-shaped lift member supported from an I-beam that rides on the truck lift members.

Lynch U.S. Pat. No. 3,930,585, discloses a lift fork extension using a slightly different swivel connection than those shown in the McCracken and Stevenson patents.

Miles, et al. U.S. Pat. No. 3,850,322, for Side Loading Device for Fork Lift Trucks, discloses a swivel platform attachment for lift trucks.

Russian Inventor's Certificate No. 267472 discloses a fork lift truck with swivel hook attachment at its forward end.

Russian Inventor's Certificate No. 540876, discloses a lift truck attachment for lifting differently shaped loads.

Of the above prior art, only Stevenson and Miles disclose the use of an intermediary extension structure for going from the forks of a fork lift truck to extended surrogate forks, but neither of these patents anticipate the use of a relatively long, single channel member with a much shorter lift or guard strap at each end as the entire extending and interconnecting member between the lift truck forks and the corresponding surrogate forks. None of the other prior art references disclose this structure, and most disclose and require separate locking means (bolts, etc.) for maintaining the extension member is the desired physical relationship between the forks of the lift truck and the forks at the load.

SUMMARY OF THE INVENTION

As noted in the drawing and specification, this invention is extremely simple and economical, and yet very effective for the purpose intended, which is to provide an extension and intermediary connection between the forks of a lift fork truck and surrogate forks which permit a pallet or similar load to be lifted from a lower lever and at a distance from the lift truck.

In my copending application, I provided an extension member which comprised a square tubing that was attached by set screws to both the forks of the lift truck and to both of the S-shaped members which comprised the surrogate forks. This tubing works satisfactory for its purpose, but it is expensive and requires careful alignment in a horizontal direction. I have now determined that the less expensive channel with a short (generally 6" or less) steel strap attached to each end will do a better job in this application, because it does not require the precise alignment when inserting the forks or the surrogate forks member into the ends of the extension member. For example, if there is substantial tolerance between the members, when the forks and the extension member channel 104 are aligned vertically, a slight upward tilt of the extension member will not prevent it from being installed onto the fork, since there is no tubing bottom to prevent easy entrance of the fork or present a drag to the fork, and when the extension member M is released, gravity will seat it properly onto the fork. Similarly, if there is sufficient tolerance when the S-shaped member S is inserted into the distal end of the extension member channel 104, it may be tilted downward, but will still enter correctly, and it too will be seated by gravity when released by the installer.

DESCRIPTION OF THE PREFERRED EMBODIMENT(S)

Figure 1:
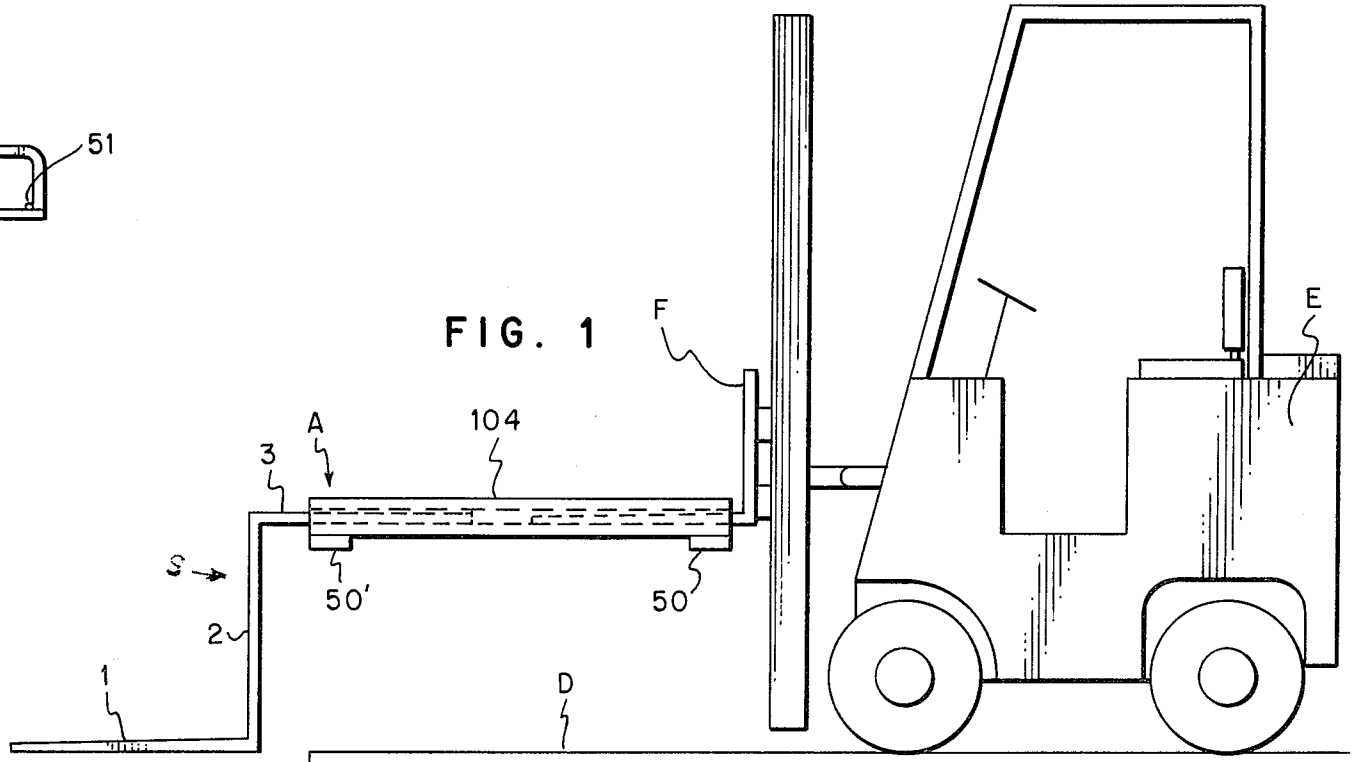
FIG. 1 is a side elevational view showing one embodiment of the extension member of this invention in its functional role as intermediary between the forks of lift fork trucks the displaced surrogate forks.
Figure 2:
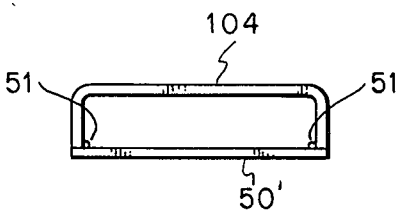
FIG. 2 is an end view, actually of either end of the extension member of FIG. 1.
Figure 3:
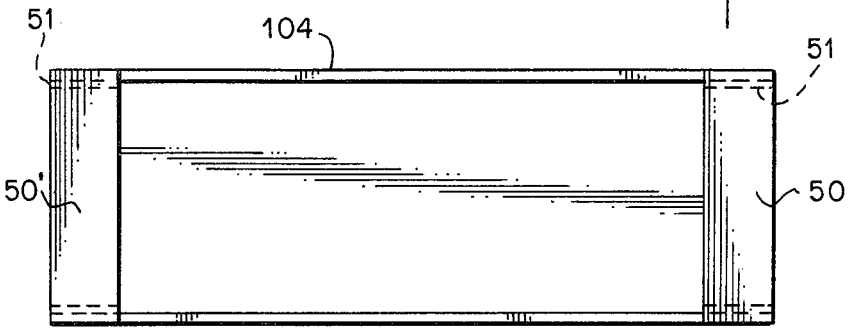
FIG. 3 is a bottom plan view of the device of FIGS. 1 & 2.
Figure 4:
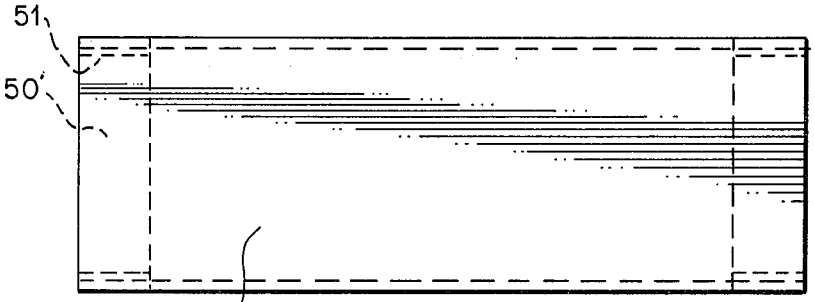
FIG. 4 is a top plan view of the device of FIGS. 1–3.

FIG. 1 shows the improved embodiment herein claimed to be a simple, economical, better functioning extension member A that interconnects the forks F of the fork lift truck E and the horizontal member 3 of an S-shaped surrogate fork member S, which combination F, A & S, permits the lift truck E to raise and transport loads that are forward and below its normal operating range.

In my copending application, the extension member (4 in that application) was comprised of square tubing and utilized set screws (6) to clamp the extension member to the truck fork and to the surrogate fork S-frame. My present invention provides a simpler, more economical, and improved operating device over the prior extension member. The present device is made up of two single pieces of channel (generally of iron or steel) 104 of the desired length to accommodate and over-lay a portion of both the forks F of the lift truck and the horizontal members 3 of the S-shaped surrogate fork members S without interference inside the channel extension member A. The channel 104 becomes extension member M when the short straps 50 and 50' are welded across the open bottom area of the channel 104 and onto the sides of the channel as shown at 51. Other welding locations may be employed if desired without changing the scope of this invention. For example, outside of the sidewalls where a slightly longer strap is employed. The straps 50 & 50' are of substantially the same size and are attached at the same location to the underside of each channel end, so as to make the ends interchangeable in use, even tho the straps 50 & 50' have a slightly different function in actual use, i.e., 50 acts as a brace and a guard to prevent channel 104 from coming off the truck forks F during lift operations, whereas 50' acts as a lift bar as well as a guard and brace, and when fork F is raised it bears against the underside of channel 104 to impart a lift force thereto, and is braced by strap 50, whereas horizontal member 3 bears against lift bar 50' and receives a lift therefrom, and is braced by channel 104 during the lift operation. No attempt is made herein to identify the magnitude or the vectors of the forces involved, altho it will be recognized that there is substantial structural interaction between all of the members, F, 3, 104, 50 and 50', as well as with weld 51.

In FIG. 1 it will be observed that the horizontal member of fork F extends into channel 104 of extension member A, but terminates short of the midpoint of the channel length; similarly, horizontal member 3 of the S-shaped surrogate fork extends into the opposite end of member A, but it also terminates short of the midpoint, so that there is no possibility of interference between the horizontal members within the channel 104.

What is claimed is:

1. In a fork lift truck having forwardly extending forks, a. surrogate fork members comprising an upper horizontal portion, a vertically extending central portion, and a lower surrogate fork portion, operatively positioned ahead of said forks, b. said surrogate fork portions of said surrogate fork members extending forward and substantially parallel to said truck forks, c. an extension member intermediate said truck forks and said surrogate fork members and joining them in operative relationship, d. said extension members comprising channels overlying portions of said truck forks and portions of said upper horizontal portions of said surrogate fork members, e. forward and rearward straps of a width shorter than their length attached to and extending across the underside of said channels near the ends thereof, wherein the rearward straps underlie said forks and the forward straps underlie said upper horizontal portion of said surrogate fork members.

2. An extension member as in claim 1, wherein the length of said channel exceeds the combined overlaid portions of the lengths of said truck forks and said upper horizontal portion of said surrogate fork members extending into said channel.

3. An extension member as in claim 1, wherein said straps are all substantially the same width, and which width is substantially less than one-half the length of said channel.

4. An extension member as in claim 3, wherein said straps are attached to said extension members at substantially the same location relative to the ends of said extension members.

5. An extension member as in claim 1, wherein the width of said channel is such as to provide at least an easy sliding fit over all of said forks.

6. An extension member as in claim 1, wherein the ends of said channels are interchangeable in operation with either said truck forks or said surrogate fork members.

7. An extension member as in claim 1, wherein all of the connections between said extension members, said truck forks, and said surrogate fork members are frictional in nature.

* * * * *